US006389849B1

(12) United States Patent
Conti

(10) Patent No.: US 6,389,849 B1
(45) Date of Patent: May 21, 2002

(54) METHOD AND DEVICE FOR CLOSING THE TOE OF A TUBULAR ARTICLE ON A KNITTING MACHINE

(75) Inventor: Paolo Conti, Florence (IT)

(73) Assignee: Metalworking and Finance Group International S.A., Luxembourg (LU)

( * ) Notice: Subject to any disclaimer, the term of this patent is extended or adjusted under 35 U.S.C. 154(b) by 0 days.

(21) Appl. No.: 09/720,684

(22) PCT Filed: Jul. 1, 1999

(86) PCT No.: PCT/IT99/00198

§ 371 Date: Feb. 27, 2001

§ 102(e) Date: Feb. 27, 2001

(87) PCT Pub. No.: WO00/01869

PCT Pub. Date: Jan. 13, 2000

(30) Foreign Application Priority Data

Jul. 7, 1998 (IT) ..... FI98A0164

(51) Int. Cl.[7] ..... D04B 9/40
(52) U.S. Cl. ..... 66/148
(58) Field of Search ..... 66/148, 147, 149 R, 66/150, 151, 152, 153, 149.5, 58, 43, 46, 47, 48, 49

(56) References Cited

U.S. PATENT DOCUMENTS 5,487,281 A * 1/1996 Frullini et al. ..... 665/58
5,570,591 A * 11/1996 Frullini et al. ..... 66/58
5,606,876 A * 3/1997 Sangiacomo ..... 66/58

FOREIGN PATENT DOCUMENTS

| | | |
|---|---|---|
| EP | 0 592 376 A1 | 4/1994 |
| EP | 0 635 593 A1 | 1/1995 |
| EP | 0 679 746 A2 | 11/1995 |
| WO | WO 97/04153 | 2/1997 |

* cited by examiner

*Primary Examiner*—Danny Worrell
(74) *Attorney, Agent, or Firm*—McGlew and Tuttle, P.C.

(57) ABSTRACT

A method is described for the production of a tubular knitted article on a circular knitting machine, in which a needle cylinder knits said tubular article (M) beginning at an initial end and finishing at a final end. At the end of the knitting of said tubular article, the latter is partly released from the needles (5), engaged by transfer members (21, 23) and then released completely from the needles and transferred to means for closing said second end.

33 Claims, 16 Drawing Sheets

METHOD AND DEVICE FOR CLOSING THE TOE OF A TUBULAR ARTICLE ON A KNITTING MACHINE

DESCRIPTION

1. Technical Field

The present invention relates to a method for the production of a tubular knitted article with a closed end, for example such as a sock, a stocking, a tubular part for the production of tights, or the like.

More specifically, the invention relates to a method of the abovementioned type in which the tubular article is produced on a circular knitting machine with a circular bed or needle cylinder, and in which the end is closed on the same machine as that on which the article was knitted, subsequent to the knitting of this article.

The invention also relates to a device for closing the end of the tubular knitted article directly on the machine by which the article was knitted.

2. State of the Art

In the production of tubular knitted articles, such as stockings, socks, tubular parts for tights and the like, the tubular articles are normally knitted beginning at an initial end and finishing at a final end on a needle cylinder. The tubular article produced in this way has two open ends, one of which must then be closed by sewing or some other suitable method. The article with its open ends is normally released from the needle bed or cylinder of the knitting machine and transferred to a sewing machine where, sometimes with partial manual intervention, the article must be correctly positioned and the end to be closed must then be fed into a sewing machine. If, as often happens, the article is not symmetrical but has, for example, a heel, it must first be correctly oriented before the seam is put in, so that the seam is correctly oriented relative to the heel. This involves a large labor input and therefore high costs.

This process is very time-consuming and costly owing in part to the need to provide machinery for positioning and sewing articles that have been produced on a separate knitting machine.

In order to eliminate these problems, a method and a device have been suggested (see EP-A-0,592,376) for closing an end, that is the toe, of the tubular article directly on the circular needle bed or cylinder of the knitting machine. In this known method the tubular article is knitted beginning at the end with the elasticated cuff and continuing to knit all the way to the edges which are joined correctly together to form the closed toe of the article. This known method is highly complex and requires a knitting machine equipped with specially formed fabric-forming members, which also raise considerably difficulties of control. Moreover the seam is produced on the outside of the article rather than on the inside as would be more desirable and as normally happens in systems in which sewing is carried out away from the knitting machine.

Methods and devices have also been suggested in which the toe of the article is closed as the initial step in a knitting process, which therefore starts with the closed end and finishes at the open end comprising the elasticated cuff. Methods and devices of this kind are described for example in WO A 95/31595, WO A 95/34702 and WO A 97/04153.

OBJECTS OF THE INVENTION

An initial object of the present invention is to provide a process or method for producing a tubular knitted article in which the tubular article is obtained with its lower end closed without requiring manual intervention to orient it.

Another object of the present invention is to provide a method of the type described above capable of closing the toe of the tubular article by a very simple sewing system and in which a seam can be produced on the inside of the article.

Another object of a preferred embodiment of the present invention is to provide a method for closing the toe of a tubular article directly on the knitting machine which knitted the article.

It is also an object of the invention to provide a very simple device, with a limited number of special fabric-forming elements, capable of closing the toe of a tubular article with no difficulties of orientation of the article.

The object of a preferred embodiment of the invention is to provide a device capable of closing the toe of the article as the final step in the knitting process, dispensing with the need to transfer the tubular article from the knitting machine to sewing machines.

SUMMARY OF THE INVENTION

These and other objects and advantages, which will become clear to those skilled in the art upon reading the test which follows, are achieved with a method for the production of a tubular knitted article with a closed toe on the circular knitting machine, in which a circular needle bed or cylinder forms the tubular article beginning at an initial edge or end and finishing at a final toe or end which is to be closed. According to the invention, the method is characterized in that at the end of the knitting of the tubular article, the latter is partly released from the needles, engaged by transfer members and then released completely from the needles and transferred to means for closing the toe.

In this way the article, being engaged by the transfer members before being completely released from the needles, arrives at means of closing the toe in a correctly oriented position without the need for manual intervention.

In one particularly advantageous embodiment of the invention, the method involves the following steps:

turning the tubular article inside out at the end of the process of knitting the courses on the needle cylinder and after having engaged it on the transfer members, transferring the article to below the needle cylinder, closing the second end of the tubular article, and turning the tubular article right side out again.

The sewing or closing of the toe may take place in a machine outside of the circular machine, or inside the circular machine itself, where sewing systems, for example a small sewing machine, may be arranged.

In order to turn the article inside out in a simple and effective way, and then close the toe with a seam which, once the production process has concluded, will be situated on the inside of the tubular article rather than on the outside, an especially advantageous embodiment of the invention employs a tubular element coaxial with the needle cylinder and extending down from an upper edge located level with or slightly below the needle cylinder. During the knitting process the tubular article grows downward inside the tubular element. At the end of the knitting process, while the tubular article is still partly engages on the needles of the cylinder, the transfer members move coaxially relative to the tubular element and on the outside of this element in order to engage the article at the edges of the fabric between the upper edge of the tubular element and the needle cylinder and then pull the article down along the outside of the tubular element, turning it inside out as it passes over the upper edge of this tubular element.

At the end of the transfer process the tubular article is therefore now inside out, and still engaged on the lower portion of the tubular element, with its end that is to be closed being free underneath the lower edge of the tubular element, where a closing means, e.g. a sewing machine of a type known per se, is positioned.

Once the toe has been closed, the article must be turned inside out a second time, and thus in practice turned right side out, i.e. returned to the position in which is was originally knitted by the needle cylinder. The same transfer members can be used again for this purpose.

In a particularly advantageous embodiment, after the toe end of the article has been closed, one of the transfer members is moved until approximately coaxial with the tubular element and underneath it, and is then extended so that it enters the interior of the tubular element, taking with it the tubular article whose closed end it pushes in front of itself. The result of this is that the tubular article is turned inside out once again around the lower edge of the tubular element. From this element the article, now right side out, can be extracted by pneumatic means of a type known per se.

The device according to the invention comprises a circular needle bed, i.e. a needle cylinder, for knitting the article and is characterized by transfer members capable of engaging the tubular article at the end of the knitting process and before the article is completely released from the needles of the needle cylinder; the transfer members transfer the end of the article that is to be closed to closing means, preferably positioned underneath the needle cylinder or outside of the circular machine.

One possible and particularly advantageous embodiment of the device according to the invention employs a tubular element coaxial with the needle cylinder and extending down from an upper edge to beneath the needle cylinder. The tubular element has a smaller diameter than the needle cylinder and the transfer members are movable on the outside of the tubular element, parallel to its axis, in order to engage the tubular article close to the end which is to be closed and transfer it downward, causing it to turn inside out as it passes over the upper edge of the tubular element.

The transfer members preferably include perforating means that engage the tubular article by penetrating the knitted fabric forming the article at the fabric edges which are suitable for gripping. Because these fabric edges are cut and discarded during the closing of the article, this does not damage the final article.

The transfer members may be two in number and positioned in diametrically opposite positions with respect to the axis of the tubular element.

In a particularly simple and advantageous embodiment, the transfer members are equipped with a telescopic lengthening system, for example pneumatic or hydraulic means for extending a tubular structure. This does not preclude the use of different means, such as slides traveling along guides arranged parallel to the axis of the tubular element.

Also, advantageously, the transfer members may also be able to execute a movement perpendicular to the movement of gripping and transferring the tubular article, so that at least one of the transfer members can also be used to turn the tubular article inside out a second time (so that it ends up right side out). To this end it is advantageous if at least one of the transfer members can be moved alternately outside or inside the tubular element extending down below the needle cylinder. The second turning of the tubular article inside out (i.e. right side out) is brought about by bringing the transfer member approximately coaxially with the tubular element and then extending the transfer member axially inside the tubular element, taking with it the closed end forming the toe of the tubular article, which by this means is turned inside out as it passes over the lower edge of the tubular element. This does not however rule out the option of using separate members for the second occasion of turning the tubular article inside out—that is right side out; e.g. an additional slide placed in an intermediate position between the transfer members. Moreover, although this is less advantageous in terms of production and reduction of labor, it is also conceivable that the tubular article be turned right side out away from the knitting machine.

Other advantageous features and embodiments of the method and device according to the invention are listed in the appended dependent claims.

BRIEF DESCRIPTION OF THE DRAWINGS

A clearer understanding of the invention will be gained from the description and the accompanying drawing, the latter showing a practical, non-restrictive example of the invention. In the drawing:

FIGS. 22 to 28 show a different embodiment of the tubular element in various conditions during the knitting cycle, wherein FIGS. 22 and 23 are sections along lines XXII—XXII and XXIII—XXIII of FIG. 24 respectively.

DETAILED DESCRIPTION OF THE PREFERRED EMBODIMENT OF THE INVENTION

Figure 1:
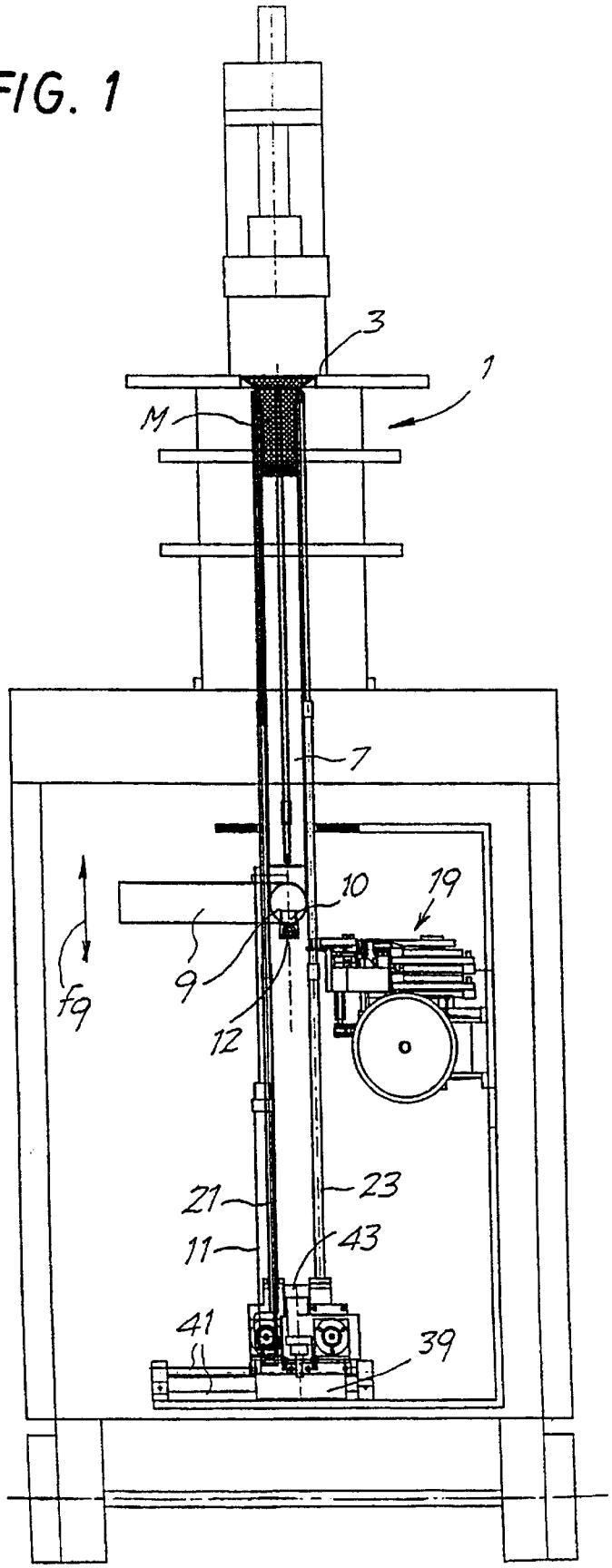
FIG. 1 shows a schematic front view of a machine according to the invention.
Figure 2:
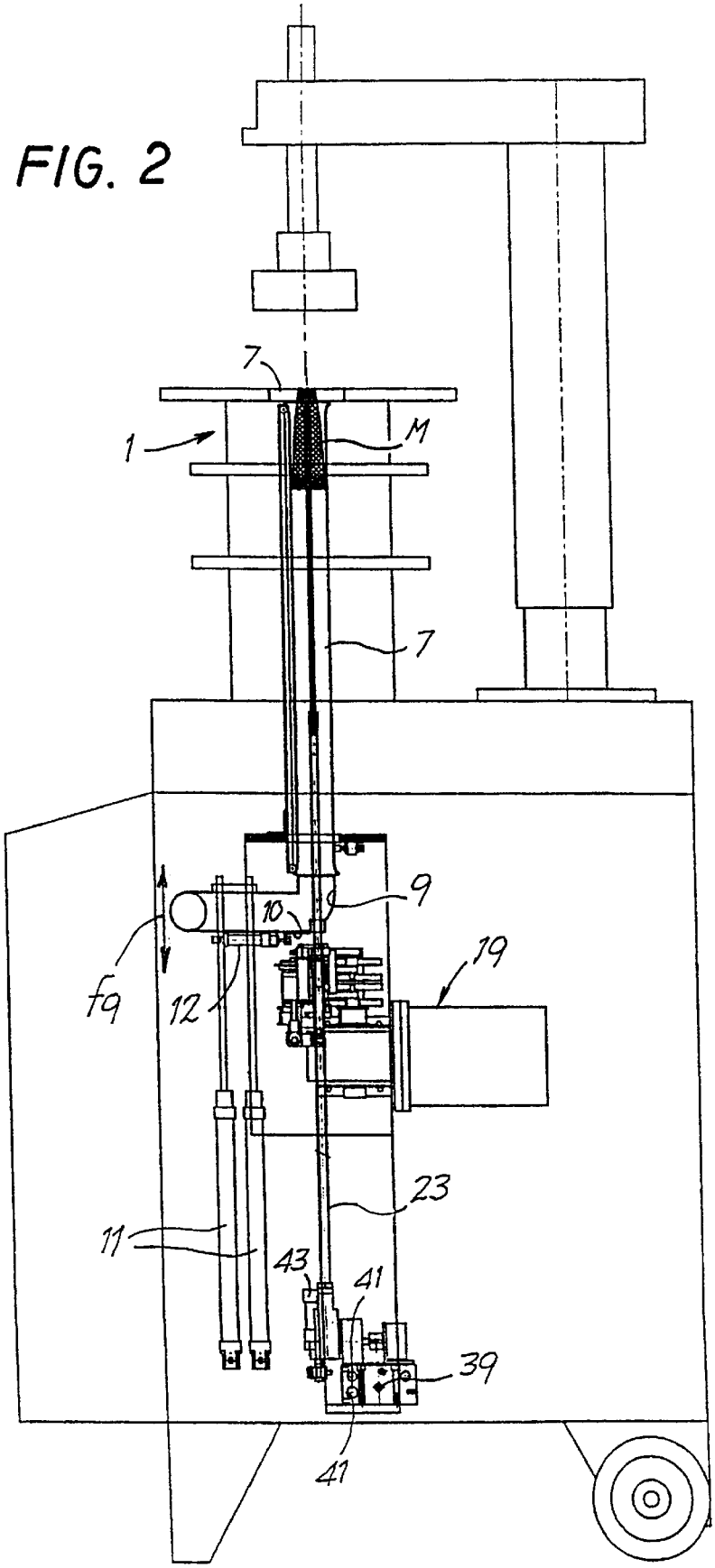
FIG. 2 shows a side view in the direction indicated by II—II in FIG. 1.

FIGS. 1 and 2 show general views of a circular knitting machine produced with the device of the present invention.

The number 1 is a general reference for the cylinder for the needles, containing at 3 a needle cylinder, that is a circular needle bed. The cylinder is of the rotary type. Subsequence figures show the needles 5 of the needle cylinder 3. The cylinder 1, the needle cylinder 3 and the fabric-forming members (not shown) for operating the needles are of a type that is known per se and will not be described in greater detail here.

Extending down below the circular bed 3 of needles 5 is a tubular element 7 that is essentially coaxial with the cylinder 1 and with the circular bed 3. The tubular element 7 has an upper edge 7A and a lower edge 7B. Both the upper edge 7A and the lower edge 7B are flared and rounded for reasons that will be described later.

Connected to the lower end of the tubular element 7 is a suction sleeve 9 which pneumatically draws away the tubular articles as they form on the circular bed 3. The sleeve 9 is vertically movable as shown by the double arrow *f*9 (FIGS. 1 and 2) and for this purpose is connected to a pair of cylinder-and-piston actuators 11. The sleeve includes an openable portion 10 opened by a cylinder-and-piston actuator 12.

Figure 5:
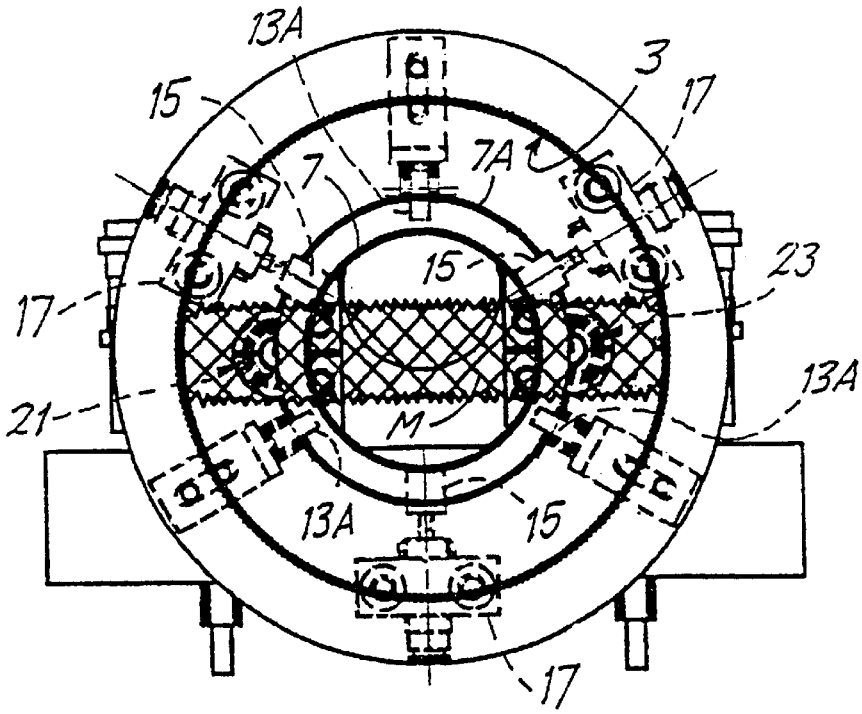
FIG. 5 shows a plan view on V—V as marked in FIG. 3.
Figure 8:
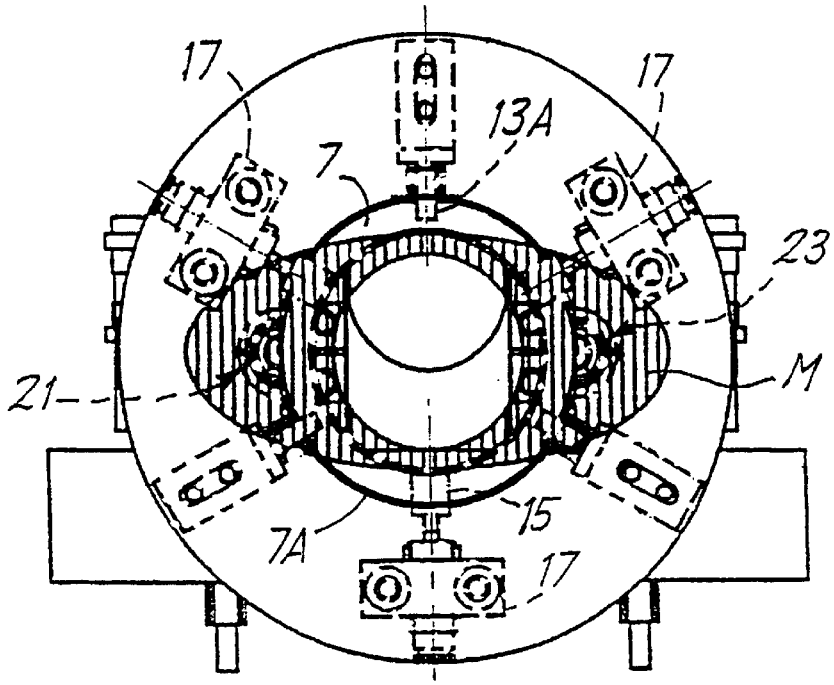
FIGS. 7 and 8 show a section and a plan view on VII—VII and VIII—VIII as marked in FIG. 6.

The tubular element 7 is supported by three pairs of rollers 13A, 13B arranged at angular intervals of 120°, as visible in FIGS. 5 and 8 in particular. The rollers 13A, 13B of each pair are situated close to the upper flared edge 7A and lower flared edge 7B, respectively.

In addition, around the tubular element 7 are three pressers 15. These are also offset at 120° from each other and are situated in between the pairs of rollers 13A, 13B. Each presser 15 is controlled by its own actuator 17 to be able to move toward or away from the outer surface of the tubular element 7. In this way the pressers 15 are able to immobilize the tubular element 7 by pressure and thus serve as auxiliary supporting means in conjunction with the pairs of rollers 13A, 13B, or else can move back from it to leave its outer surface free. This arrangement enables the tubular article generated by the bed 3 to be turned inside out and transferred to a sewing machine, as will be explained below. The pressers 15 may also be omitted.

Below the tubular element 7 is a sewing machine having the general reference 19: this is of a type known per se and is used to close the toes of tubular knitted articles by sewing them up. The sewing machine may be of the type normally used in machines for sewing the toes of articles usually coming from the knitting machines. As explained above, in the prior art these sewing machines are located in machines physically separated from the circular knitting machines on which the articles are formed.

Figure 17:
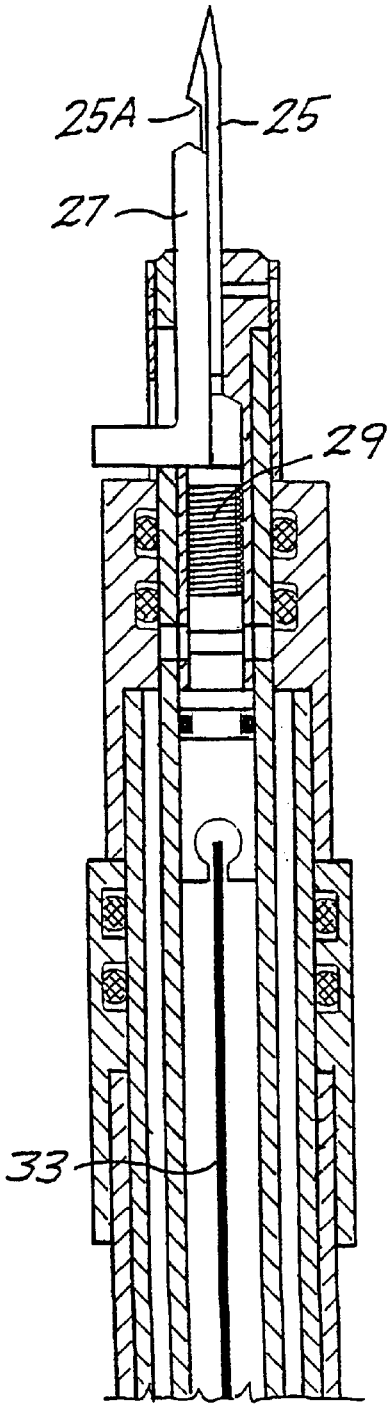
FIGS. 17 and 18 show a detail of the gripping system of the transfer members in two different positions.
Figure 18:
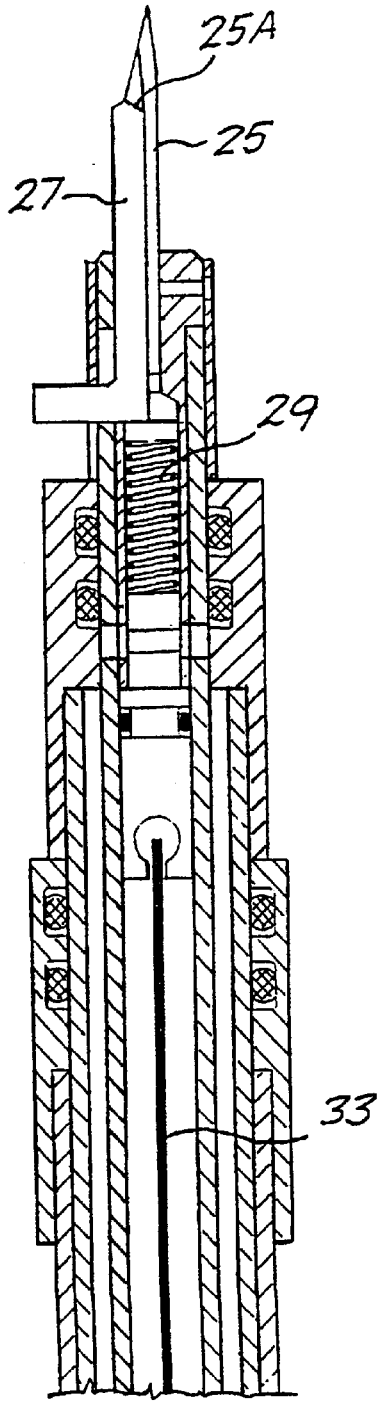

Transfer members 21, 23 run down the outside of the tubular element 7. They consist of extendable telescopic tubular elements equipped at their upper ends with gripping means in the form of hooks, needles or the like which are shown in detail in FIGS. 17 and 18. For each transfer member 21, 23 there is a hook 25 with a closing element consisting of a slide 27 urged into the closed position by an elastic member 29. In FIG. 17 the hook member is shown in the open position, with the side 27 down and the elastic member 29 compressed, while FIG. 18 shows the slide 27 closed, abutting against an inclined surface 25A on the hook 25 and the elastic member 29 expanded.

Figure 19:
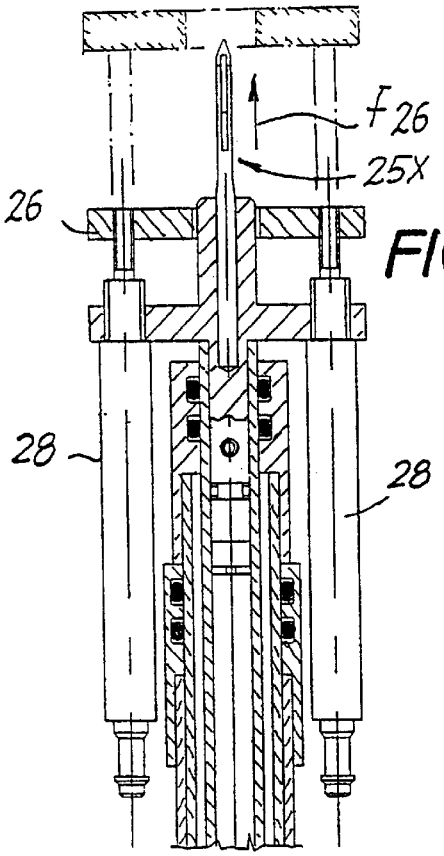
FIGS. 19 and 20 are a front view and a side view of a different embodiment of the gripping systems of the transfer members.
Figure 20:
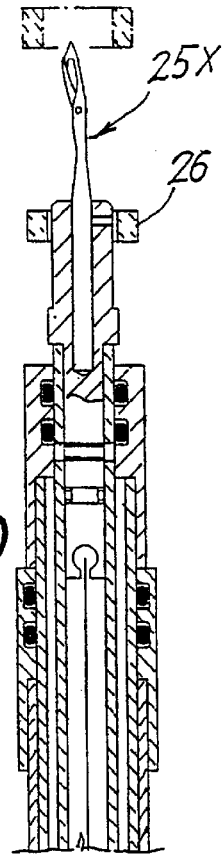

FIGS. 19 and 20 show a modified embodiment of the transfer members, in which the hook 25 is replaced with a latch needle 25X mounted on the top end of the telescopically extendable system. Around the needle 25X is an extraction member 26 operated by cylinder-and-piston actuators 28. The extraction member is raised as shown by the arrow *f*26 when the transfer member is used to turn the tubular article inside out a second time, once the toe is sown.

Figure 3:
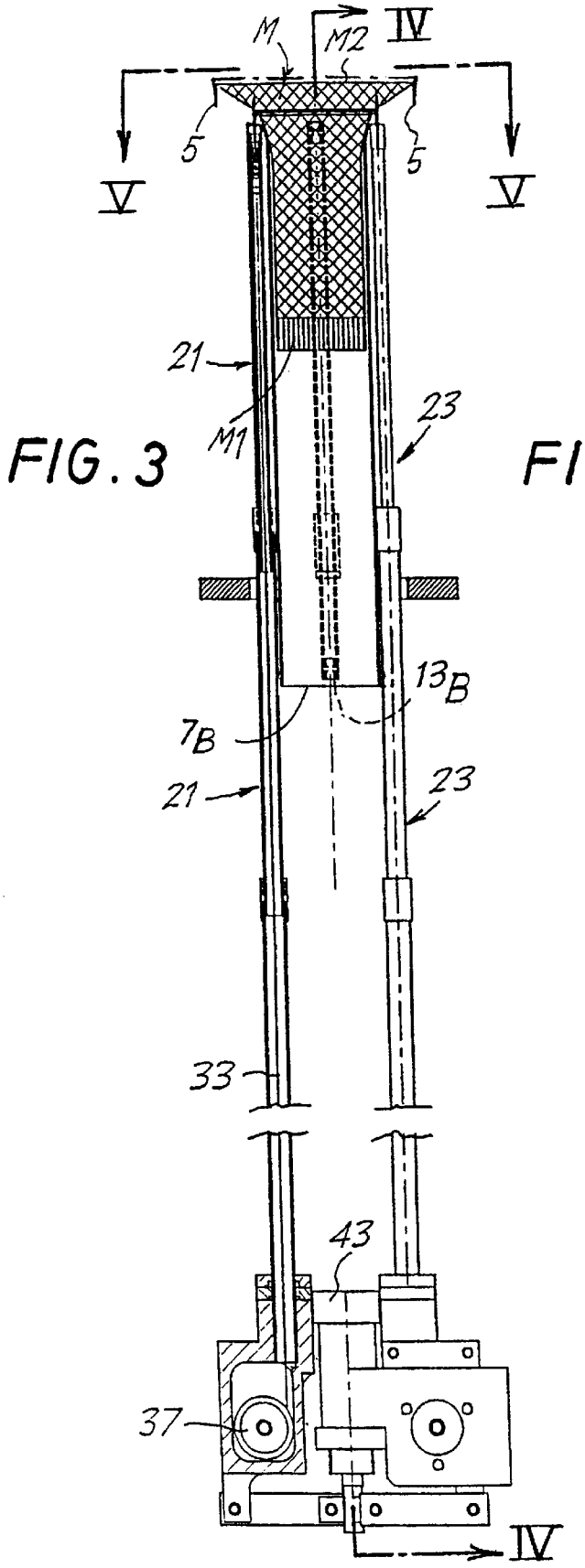
FIG. 3 shows an enlargement of the tubular element and the transfer members as they grip the article before it is completely released by the needle cylinder in a front view similar to the view of FIG. 1.
Figure 4:
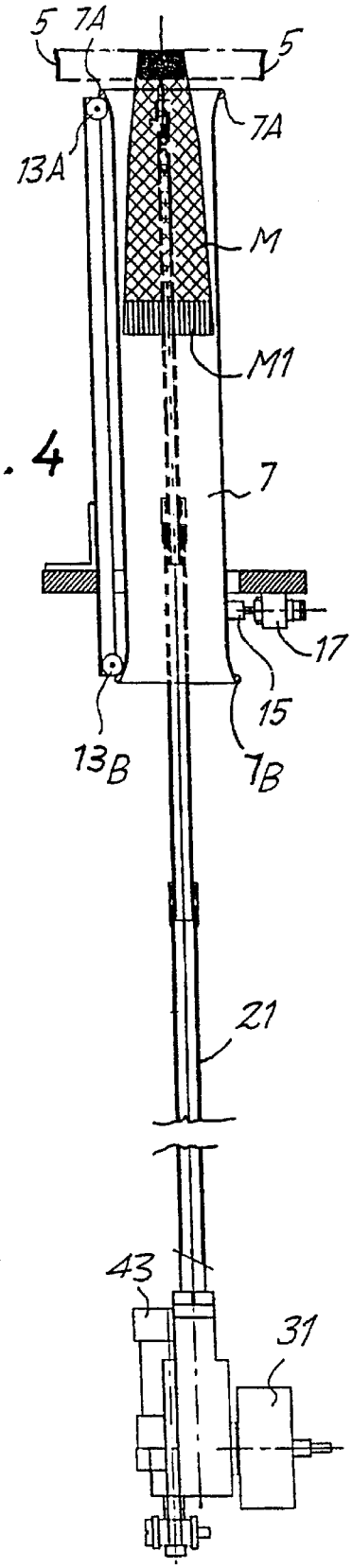
FIG. 4 shows a section on IV—IV as marked in FIG. 3.
Figure 6:
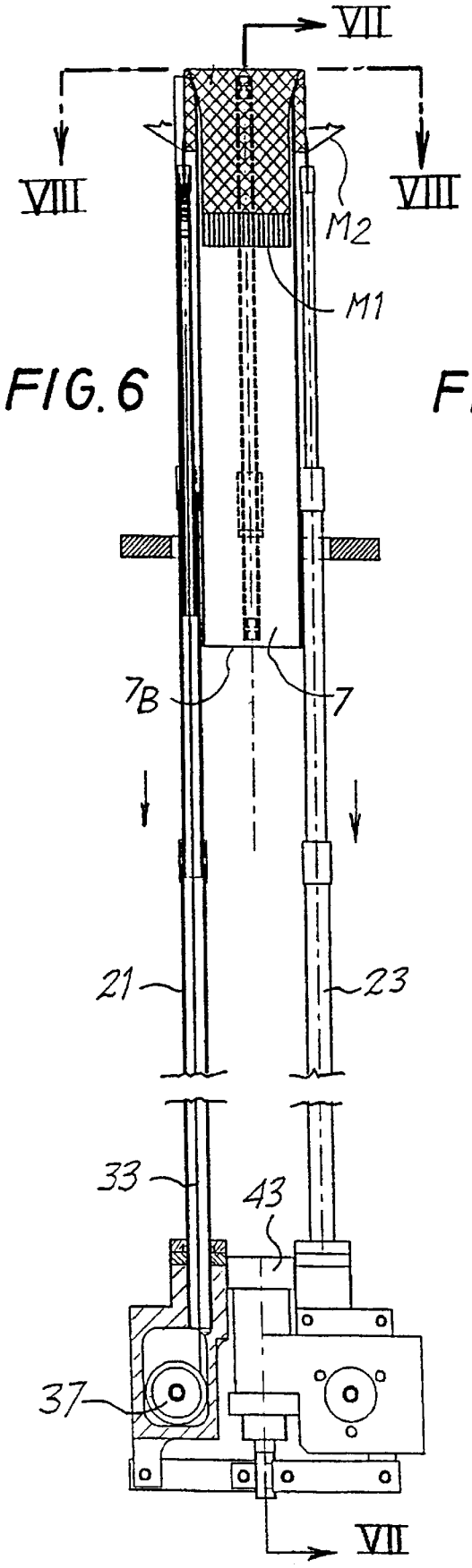
FIG. 6 shows a view similar to the view of FIG. 3 in a subsequent step in the process.
Figure 7:
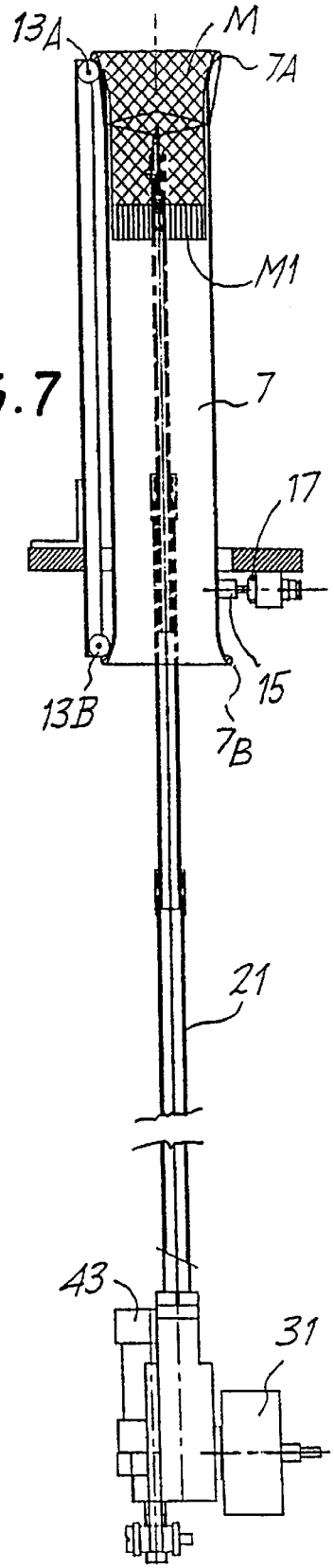

The telescopic lengthening of the tubular system of the transfer members 21, 23 is brought about by pumping a fluid under pressure into the cavities of the tubular elements through connectors 31 (see FIGS. 4 and 7 in particular). The fluid pumped under pressure into the telescopic tubular members produces upward lengthening, and retraction is brought about by means of a flexible line 33 which can be wound up onto a corresponding spool 37 (see FIGS. 3 and 6 in particular).

The transfer members are carried by a carriage 39 that moves on guide bars 41 fixed to the machine structure (see in particular FIG. 1). The transfer members 21 and 23 are hinged to the carriage 39 and controlled by a cylinder-and-piston actuator 43 in such a way that they are able to pivot about horizontal axes that basically coincide with the axes of the line 33 rewinding spools 37, for reasons which will be explained later. By means of the guides 41, the transfer members 21 and 23 can be moved relative to the axis of the tubular element 7 to carry out their functions which will be described with reference to FIGS. 3–16.

The device described thus far works in the following manner.

FIG. 3 illustrates the final step in the knitting of the tubular article M by the needles 5 of the circular bed 3. The knitting of the article M commences at the end M1 which, for example in the case of a sock, is given an elastic cuff. The knitting action is produced by rotating the circular bed 3 of the needles 5 and ends with the knitting of the end M2 which must be closed to form the toe of the article. During the knitting of the tubular article, shaped positions corresponding to the heel of the article, or other special portions, may be formed as in normal knitting technology.

In the position shown in FIGS. 3, 4, and 5, the tubular article M has been completed and is almost completely released from the needles 5 of the circular bed 3. Only some of the needles, for example ten or twenty needles, engage the article M in two diametrically opposite zones, as can be seen in particular in the plan view of FIG. 5. In this phase the circular bed 3 may be stationary or may still be moving at a very slow speed. The transfer members 21 and 23 have been extended upward to bring the hooks 25 into engagement with the fabric of the portion adjacent to the end M2 of the tubular article M. The hooks 25 have penetrated the article and the article is held on the hooks by closing the slide 27 of each of the transfer members 21 and 23. In the position shown in FIGS. 3, 4 and 5, the article M is therefore still engaged on the circular bed 3 of needles 5 and also engaged by the transfer members 21 and 23 which then, as will be described, transfer the article to the sewing machine 19.

In the position shown in FIGS. 1, 2 and 3 the suction sleeve 9 has been removed by a downward stroke of the actuators 11 from the tubular element 7 or permit transfer of the tubular article M to the sewing machine 19. During the knitting stage prior to this, however, the sleeve 9 was connected to the lower edge 7B of the tubular element 7 to generate a slight vacuum inside the tubular element 7, the purpose being to stretch the article M inside it as it is knitted.

Once the hooks 25 and slides 27 have firmly fixed the article M to the transfer members 21 and 23 at at least two points, the article can be completely separated from the needles 5 of the circular bed 3, which, for this purpose, completes its own rotary movement.

It is now possible to transfer the article M to the sewing machine 19. The start of this step is illustrated in FIGS. 6, 7 and 8. The transfer members 21 and 23 are gradually retracted by rewinding the lines 33 onto the spools 37. This pulls the article M down the outer wall of the tubular element 7 following the hooks 25. Consequently the article M is pulled out of the tubular element 7 and turned inside out as it passes over the flared and rounded edge 7A of the tubular element 7. The operation continues until the position shown in FIGS. 9 and 10 is reached, where the tubular article M, now completely inside out compared with the position it had during knitting, is engaged by its upper portion around the tubular element 7, which it embraces from the outside, while the lower end M2 (i.e. the last end formed by the circular bed 3) is lowermost, is still engaged between the transfer members 21 and 23 and is lower than the lower edge 7B of the tubular element 7.

Figure 9:
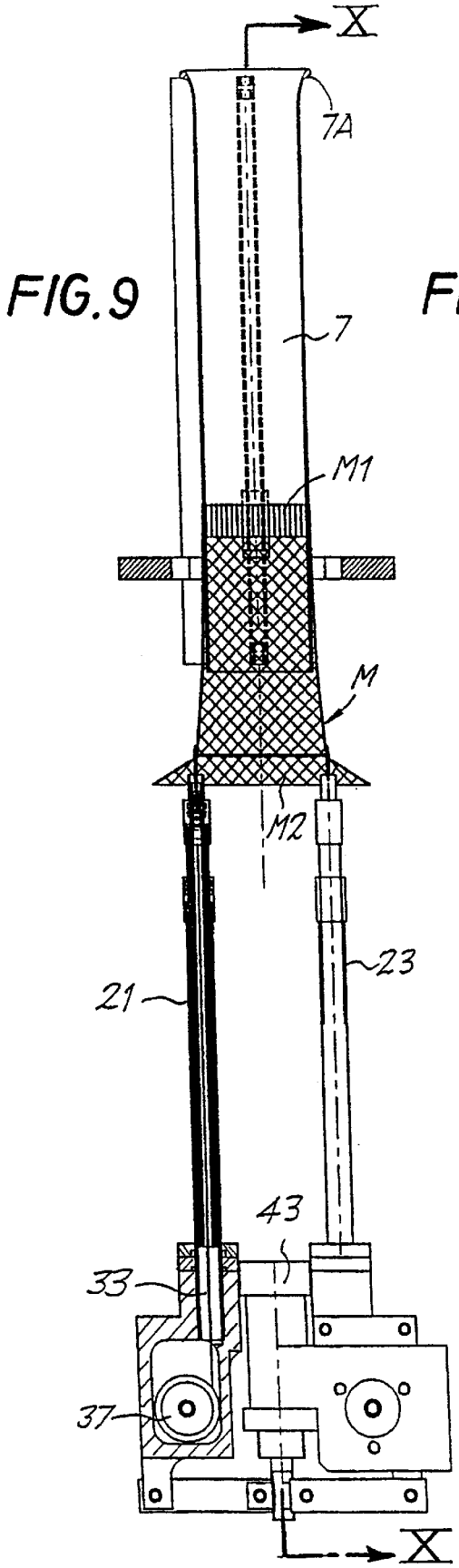
FIG. 9 shows a step following that illustrated in FIG. 6.
Figure 10:
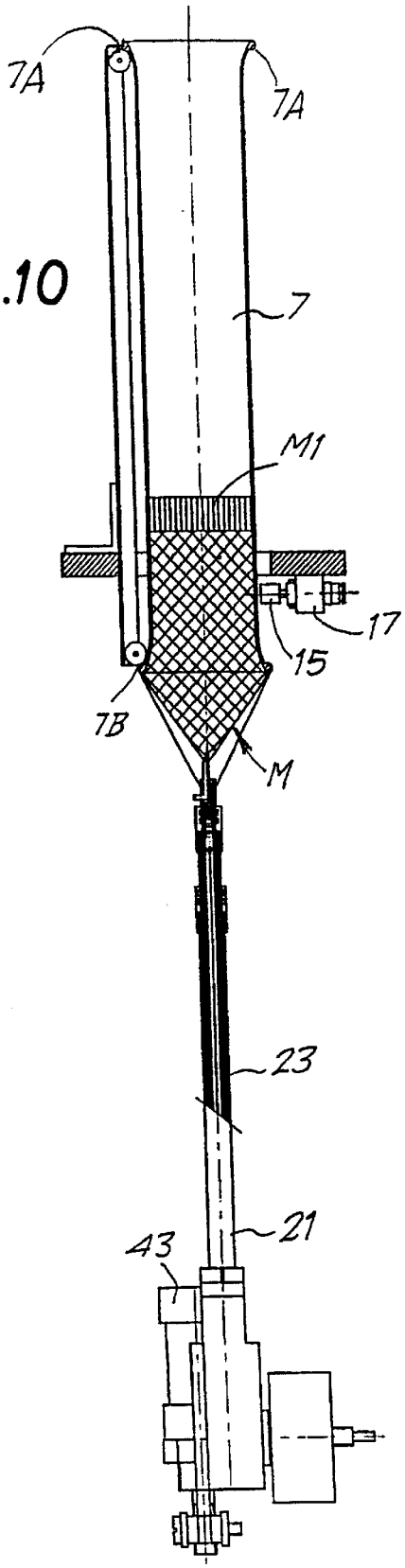
FIG. 10 shows a section marked X—X in FIG. 9.
Figure 11:
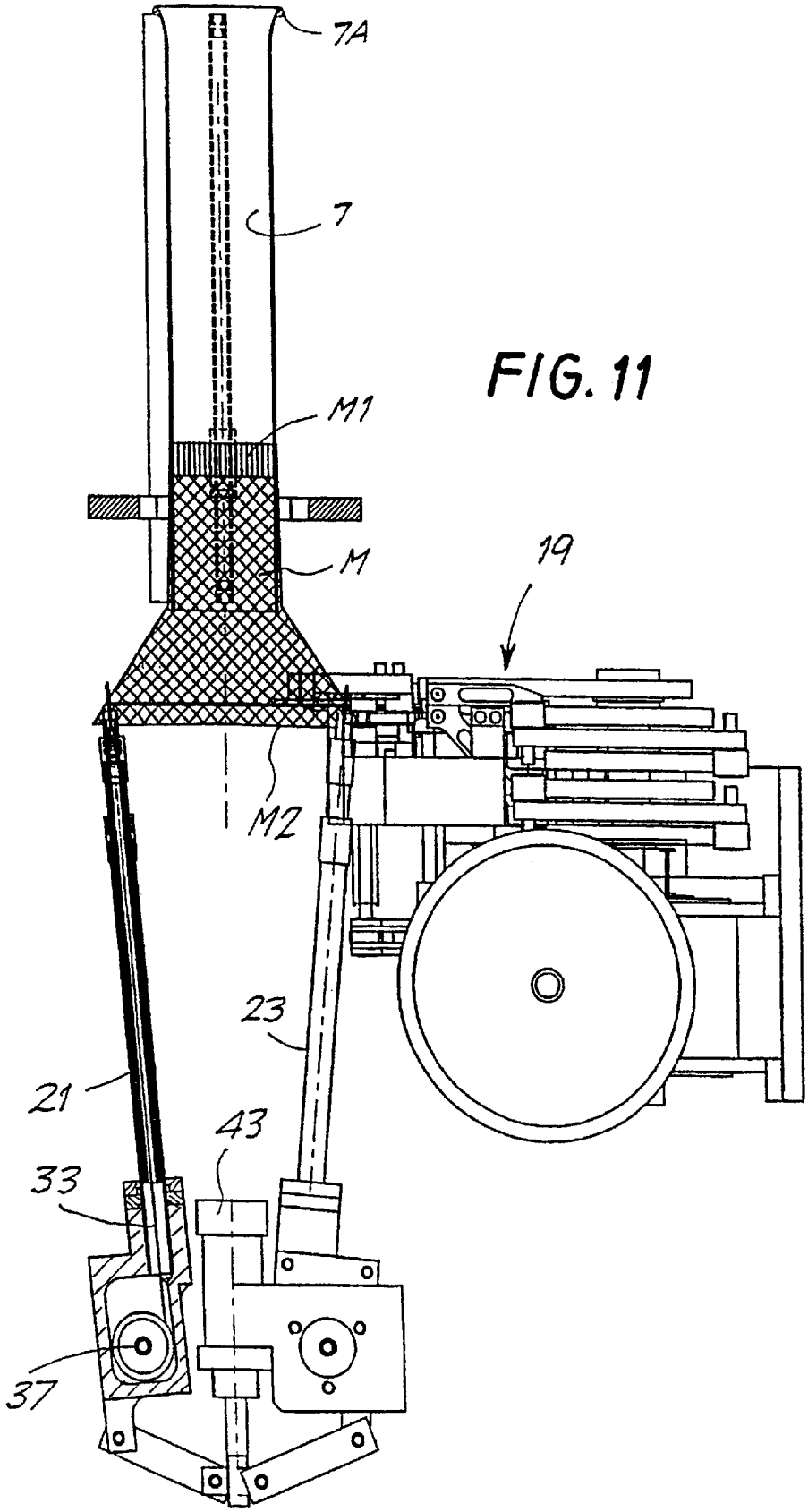
FIGS. 11, 12, 13, 14, 15 and 16 show front views in successive positions of the article, of the transfer members and of the sewing machine during the closing of the toe of the tubular article.

To allow the article M to be moved from inside the tubular element 7 to the outside of the latter, and also to allow the article M to slide all the way down the outer surface of the tubular element 7 to the position of FIGS. 9 and 10, the presser members 15 that hold the tubular element in position are retracted by the actuators 17 so that the tubular element 7 remains suspended by only the three pairs of rollers 13A, 13B. The tubular article thus passes between the rollers 13A, 13B and the outer surface of the tubular element 7 and can arrive unobstructed in the position shown in FIGS. 9 and 10.

At this point it is necessary to introduce the lower end M2 of the article, which is to be sewn to create the toe of the article, into the mouth of the sewing machine 19 (which has been omitted in the presentation of FIGS. 3–10 to simplify the drawing)

Figure 21:
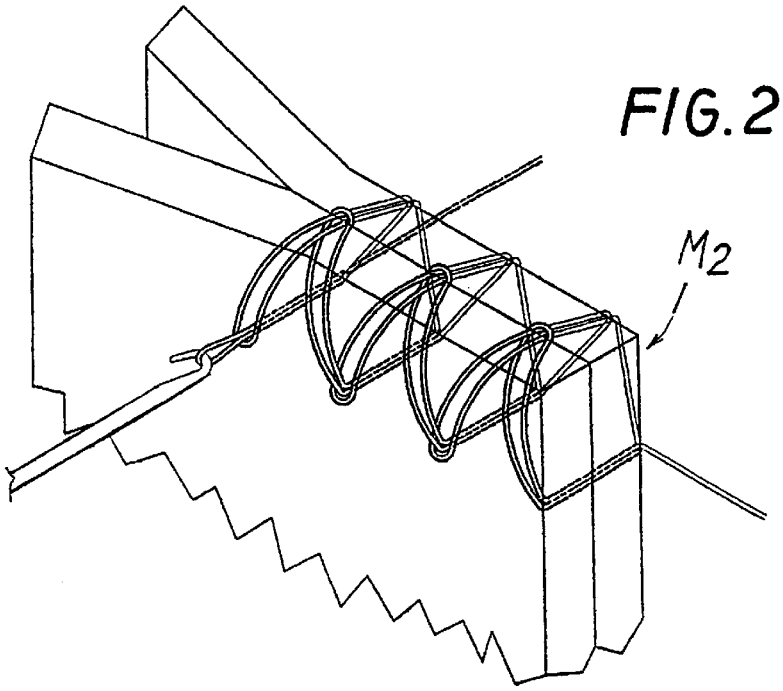
FIG. 21 is a schematic of the seam sewn along the edges of the toe of the tubular article.

To this end, provision may be made for the sewing machine 19 to execute a movement toward the axis of the tubular element 7. For greater simplicity, however, it is preferred to give at least one of the transfer members 21, 23 a pivoting movement to pull the end M2 of the tubular article M toward the mouth of the sewing machine 19. For greater simplicity of construction and also to ensure sufficient tensioning of the end M2 when sewing commences, provision is made for both transfer members 21 and 23 to pivot about horizontal axes under the action of the cylinder-and-piston actuator 43. This pivoting movement splays the transfer members 21, 23 out into the position of FIG. 11, with consequent insertion of one edge of the terminal end M2 of the tubular article M into the mouth of the sewing machine 19. The latter thus begins to operate by sewing, in a manner known per se, the edges of the lower end M2 and cutting off the final portion of the knitted fabric in a manner known per se. One type of sewing that can be used to close the end M2 of the tubular article M is shown schematically in FIG. 21, where the knitted fabric of the article is shown schematically in the form of two edges placed together, without any indication of the individual loops of which they are composed.

Figure 12:
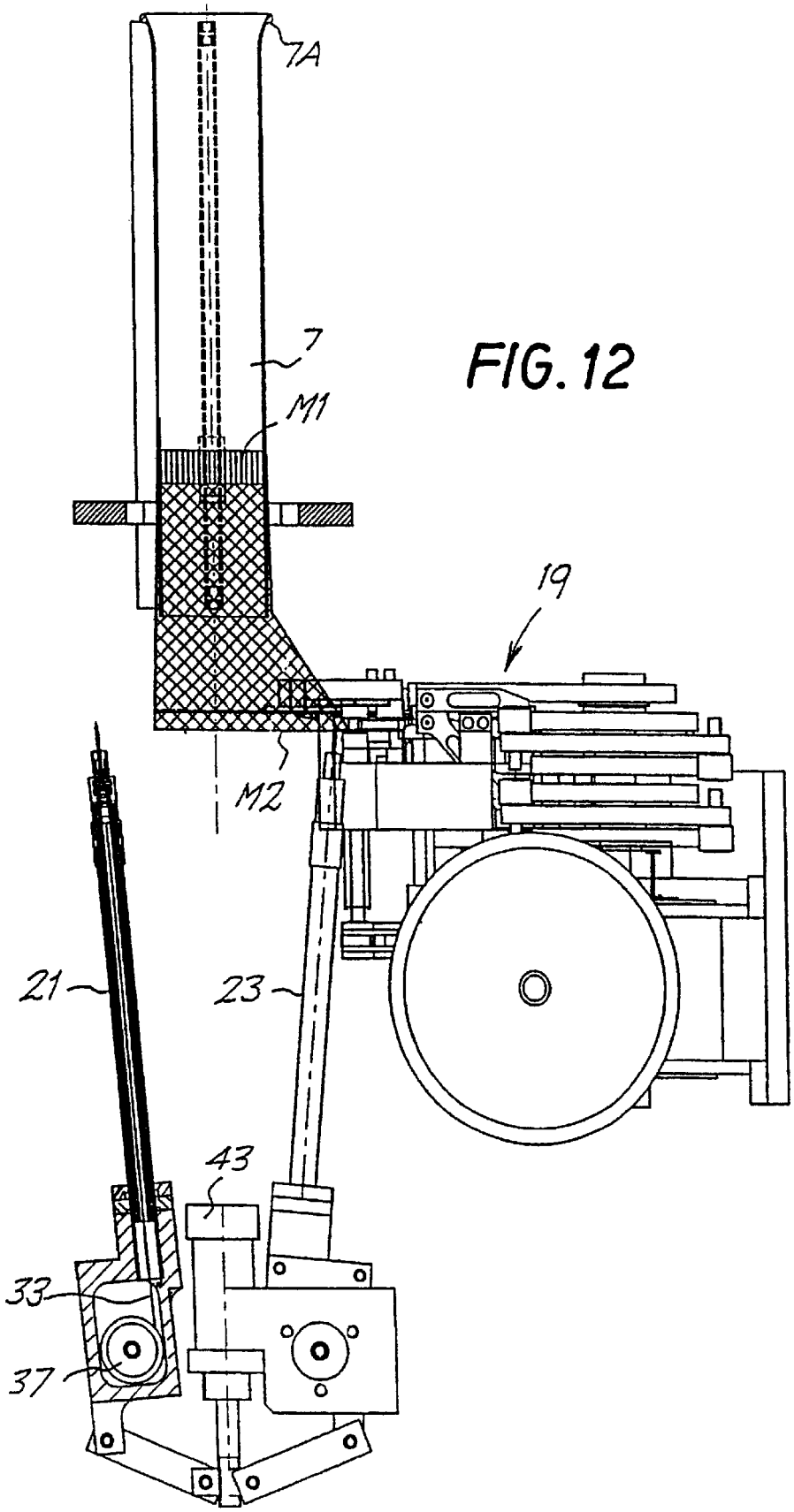
Figure 13:
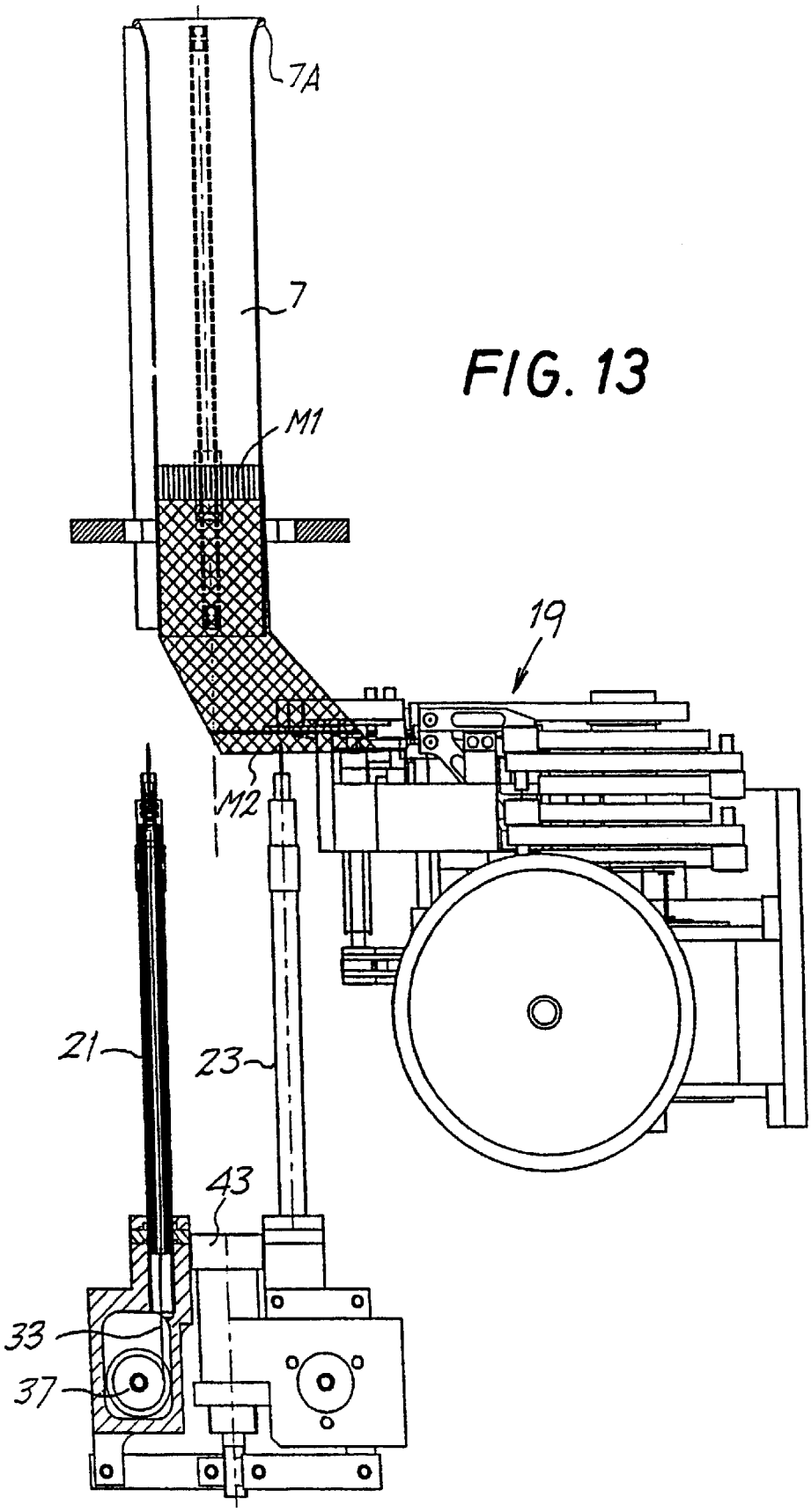

The operation of the sewing machine 19 draws the article M into the sewing machine as can be seen in FIGS. 12 and 13. In the latter figure the transfer members 21 and 23 have been moved back to the vertical position.

On completion of the closing of the tow formed by the end M2 of the article, the latter is released by the sewing machine 19 and must be turned back inside out a second time, that is turned right side out to return it to its previous position.

Figure 14:
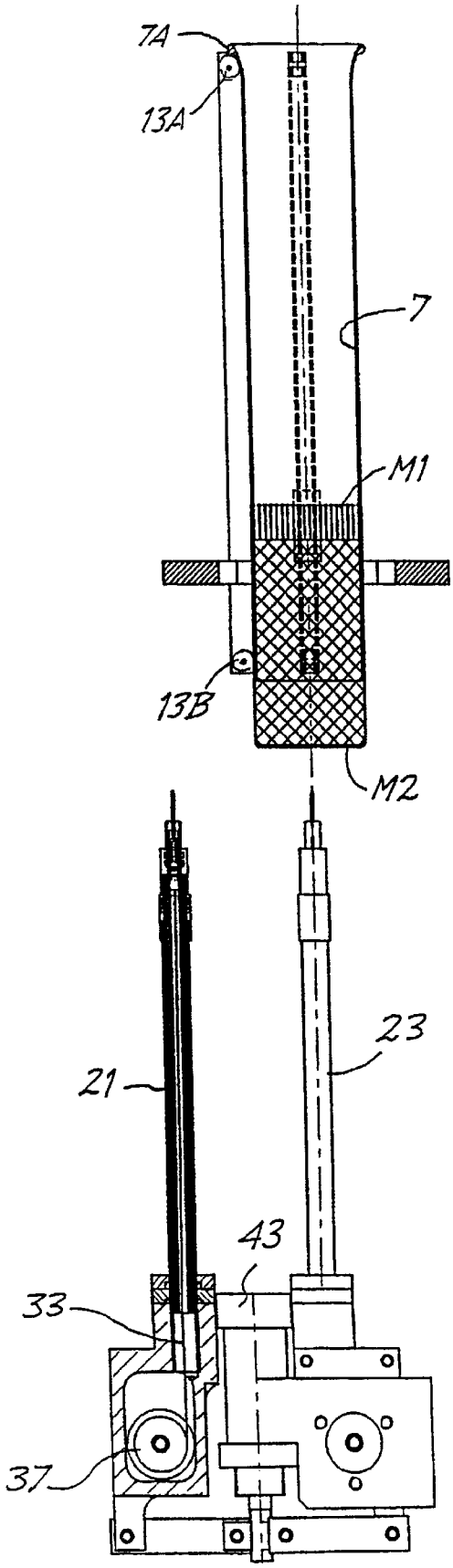
Figure 15:
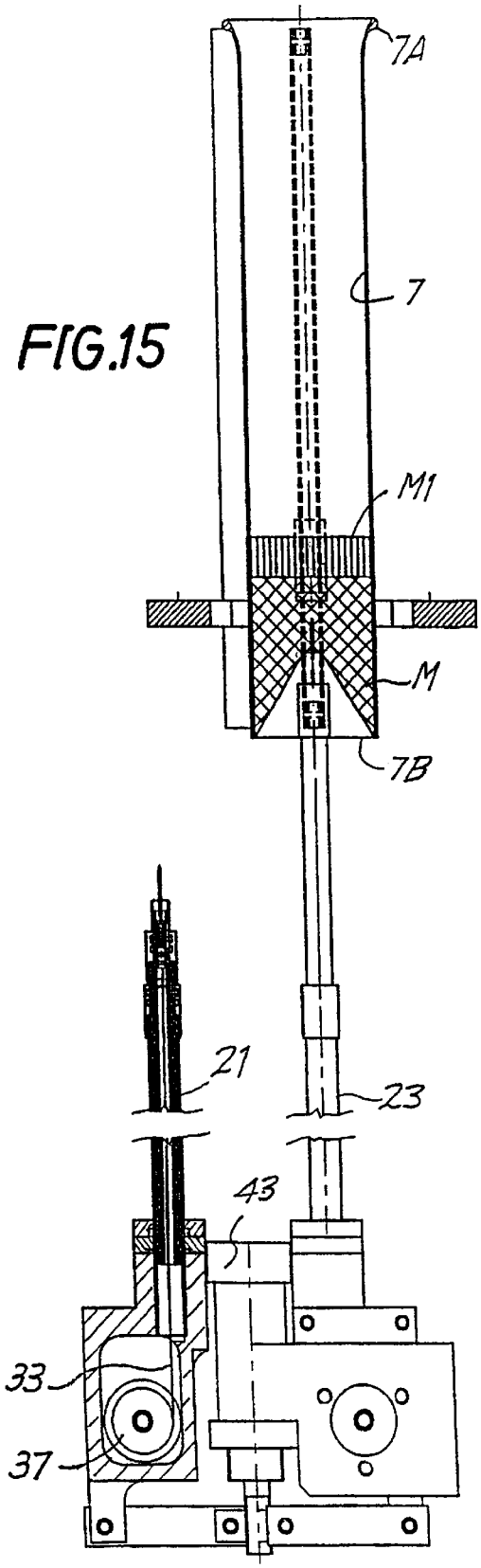

To this end the transfer members 21, 23 are traversed along the guides 41 until the transfer member 23 is approximately coaxial with the tubular element 7, as seen in FIG. 14. The subsequence extension of the transfer member 23 by telescopic lengthening pushes the article M up into the tubular element 7 as seen in FIG. 15. The article M therefore slides off the outer surface of the tubular element 7 and is turned inside out as it passes under the flared and rounded lower edge 7B of the tubular element until it reaches the final position illustrated in FIG. 16.

Figure 16:
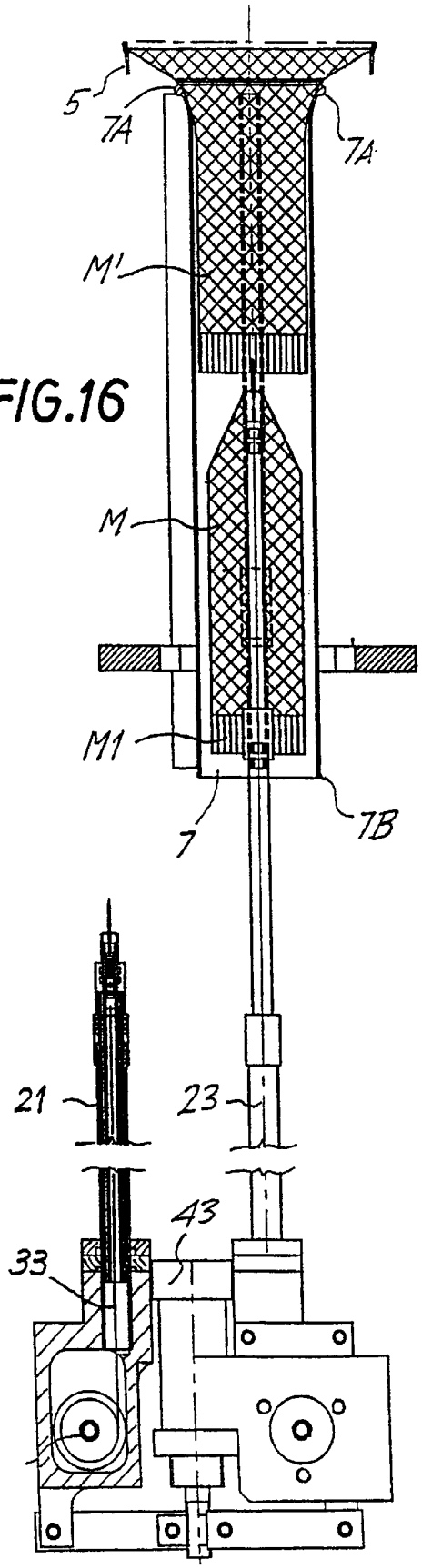

In the position of FIG. 16 the article M is once again in the position it had during its knitting and the seam formed by the sewing machine 19 is on the inside of the article, the latter having been turned inside out before the seam was made.

After the toe of the article M has been sewn and before said article begins to be inserted into the tubular element 7 by the transfer member 23, the suction sleeve 9 is raised by the actuators 11 until it is close to the lower edge 7B of the tubular element 7, but at a distance from the latter so that the article can still pass through. The openable portion 10 is opened to allow the insertion of the transfer member 23. In this position a sufficient vacuum is generated inside the tubular element 7 to pull down a new tubular article undergoing formation and to stretch the tubular article M whose toe has just been closed.

As seen in FIG. 16, a second article M' is present and being formed in the upper end of the tubular element 7, knitting of which is begun while the other article is being sewn and turned inside out a second time around the lower edge 7B of the tubular element 7. When the tubular article M whose toe has been closed is once again fully inside the tubular element 7, the transfer member 23 can be withdrawn, the openable portion 10 of the suction sleeve can be closed and the suction sleeve 9 itself can be brought fully up against the lower edge 7B of the tubular element 7. As soon as the transfer member 23 has been retracted, the article M with the closed toe is drawn away by suction inside the suction sleeve 9. The vacuum created inside the sleeve and inside the tubular element 7 maintains the tension on the new article M' as it is forming. The machine is ready to carry out a new cycle of closing the toes as soon as the article M' has been completed.

FIGS. 22 to 30 show a developed embodiment of the device according to the invention. Corresponding elements are designated with the same reference numbers as in the previous figures.

Figure 22:
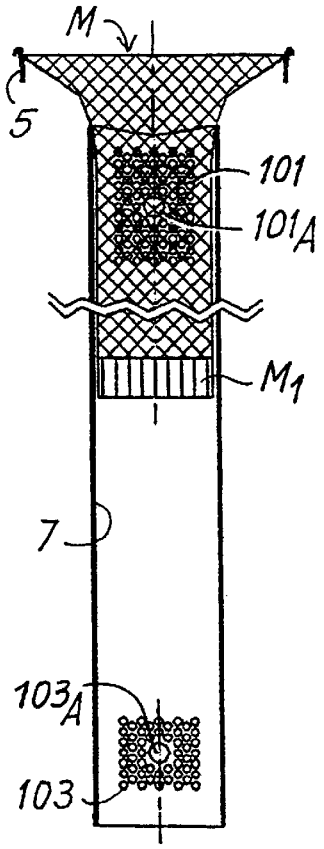

According to the embodiment of FIGS. 22–30, the tubular element 7 is provided with four perforated areas, arranged symmetrically around the axis of the tubular element. Two of said perforated areas as shown in FIG. 22 and designated 101 and 103. Each area 101, 103 is provided with a larger central hole 101A, 103A.

Two oscillating suction boxes 105, 107 are arranged side by side on the outside of the tubular element 7. Each suction box 105, 107 can pivot around a horizontal axis 105A, 107A, carried by the stationary frame 111. Each suction box 105, 107 is provided with an upper input aperture 105B, 107B arranged in correspondence of the perforated areas 101 and a lower output aperture 105C, 107C. In correspondence of the input apertures 105B, 107B each oscillating suction box 105, 107 is provided with pins 113, 115 aligned with holes 101A.

The two oscillating suction boxes 105, 107 can take two end positions: in the first position (FIGS. 24, 25) the input apertures 105B, 107B are kept clear of the outer surface of tubular element 7, and so are the pins 113, 115 with respect to holes 101A. In the second position the upper input apertures 105B, 107B are in contact with the outer surface of tubular element 7 and pins 113, 115 are introduced in holes 101A. In this second position, pins 113, 115 vertically support the tubular element 7 and the output apertures 105C, 107C are in communication with the interior of the tubular element 7 via the perforated areas 101.

Below stationary frame 111 two sliding suction boxes 121, 123 are arranged for sliding back and forth with respect to tubular element 7. The two sliding suction boxes 121, 123 have each an input aperture 121B, 123B and two output apertures 121C, 123C. The input apertures 121B, 123B are arranged at the same level as perforated areas 103 of the tubular element 7 and in correspondence thereof two pins 125, 127 are arranged which can engage into holes 103A.

The two sliding suction boxes 123, 125 can take two positions: in a first position (FIGS. 26, 27) the two sliding suction boxes 123, 125 are clear of the tubular element 7 and the pins 125, 127 are disengaged from holes 103A. In the second position (FIGS. 24, 25) the two boxes 123, 125 are in contact with the outer surface of the tubular element 7. In this second position, pins 125, 127 are inserted in holes 103A and support the tubular element 7, while the output apertures 121C, 123C are in communication with the interior of the tubular element 7 via perforated areas 103.

The suction boxes are in communication with a vacuum line via output apertures 105C, 107C, 121C, 123C.

The device shown in FIGS. 22 to 30 operates as follows: during knitting of the tubular article M the oscillating suction boxes 105, 107 and/or the sliding suction boxes 121, 123 are engaged with the outer surface of the tubular element 7 in order to generate a certain degree of vacuum therein, which sucks the article M being knitted inside the tubular element 7 and tensions it.

Figure 23:
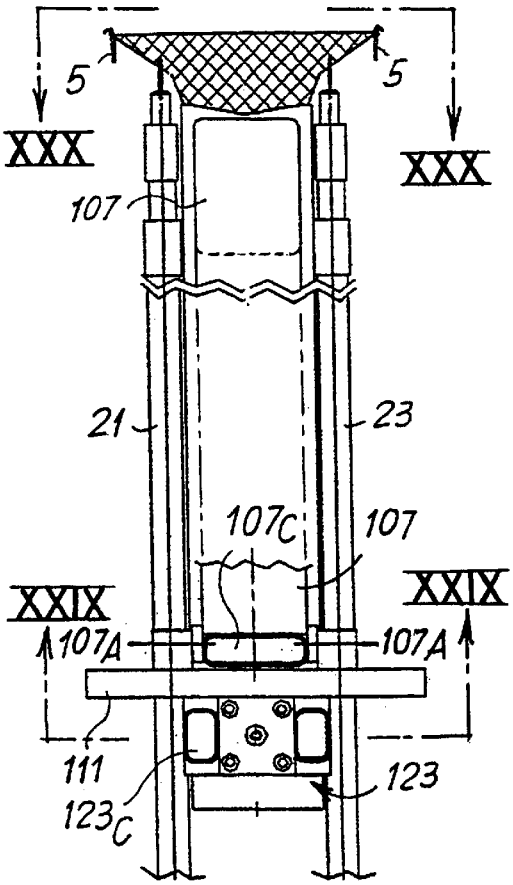
Figure 24:
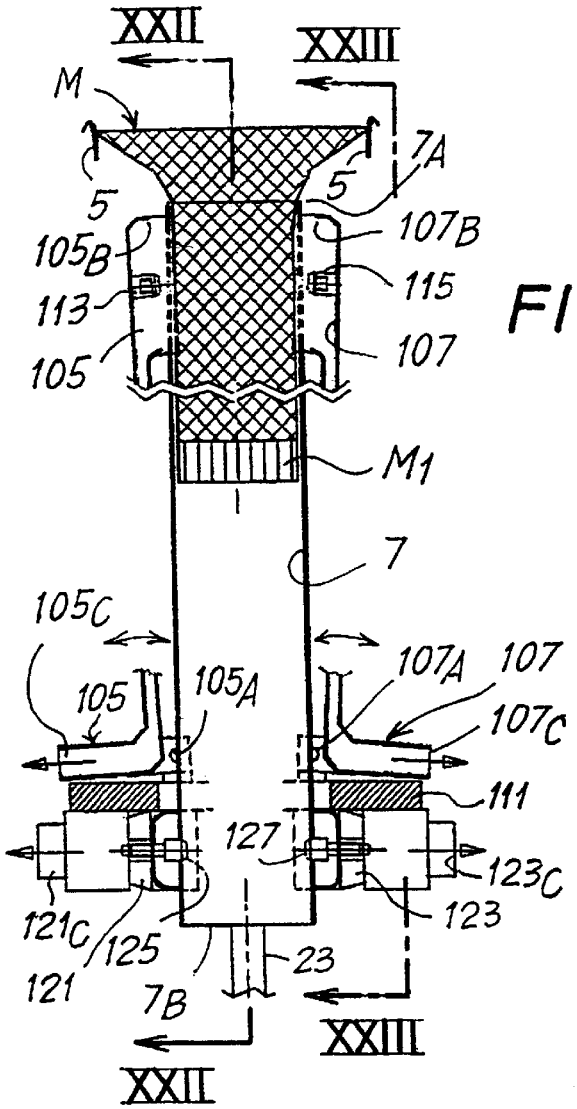
Figure 25:
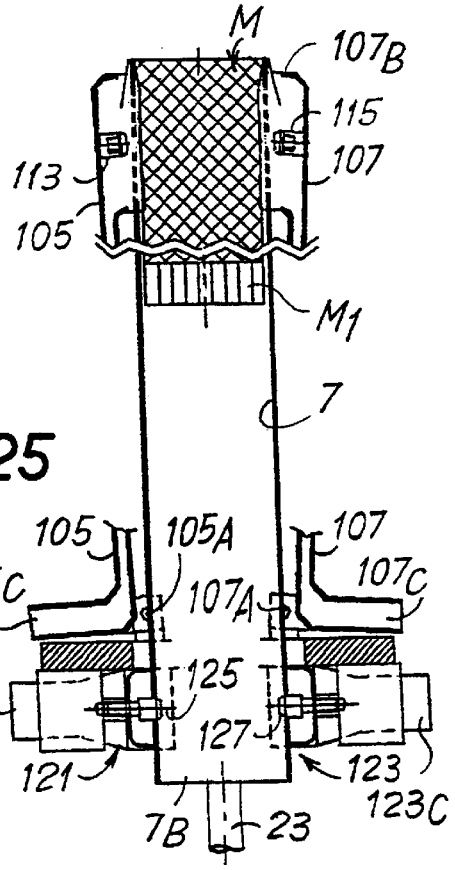
Figure 26:
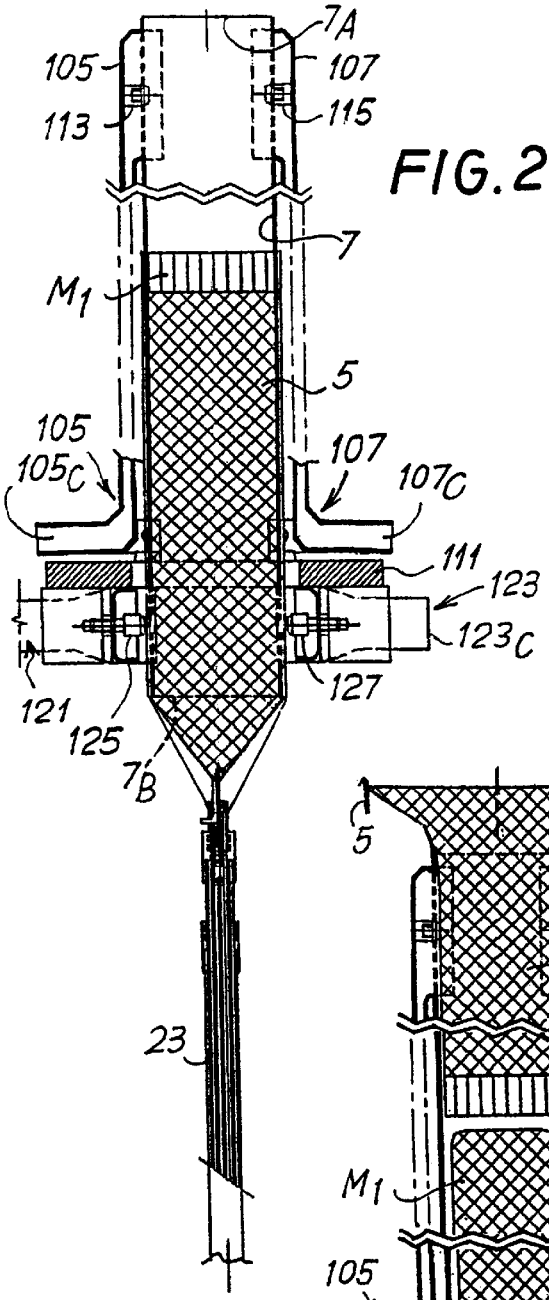

Once the knitted tubular article M has been completed (FIG. 22), the transfer members 21, 23 engage the upper edges of the article M near needles 5 (FIGS. 23, 24). The oscillating suction boxes 105, 107 are oscillated away of the outer surface of the tubular element 7, while the lower sliding suction boxes 121, 123 are in engagement with the outer surface of the tubular element 7 and keep the interior thereof under vacuum conditions. At the same time, pins 125, 127 support the tubular element 7. The transfer members 21, 23 are retracted and moved downwardly as in the previous example, thus pulling the article M out of the tubular element 7. The article is turned inside out as it passes over the upper edge 7A of the tubular element 7. Since the upper oscillating suction boxes 105, 107 are clear of the tubular element 7, the knitted tubular article M can slide along the outer surface of the tubular element 7. As soon as the end M1 of the tubular article M has passed the perforated areas 101, the oscillating suction boxes 105, 107 are oscillated against the outer surface of the tubular element 7, and pins 113, 115 are brought into engagement with holes 101A, in order to support the tubular element 7.

Correspondingly the lower sliding suction boxes 121, 123 are moved away from the outer surface of tubular element 7, thus allowing the tubular article M to pass over perforated areas 103 while moving toward the sewing machine (not shown). The article M is then closed by means of the sewing machine as previously described.

Figure 29:
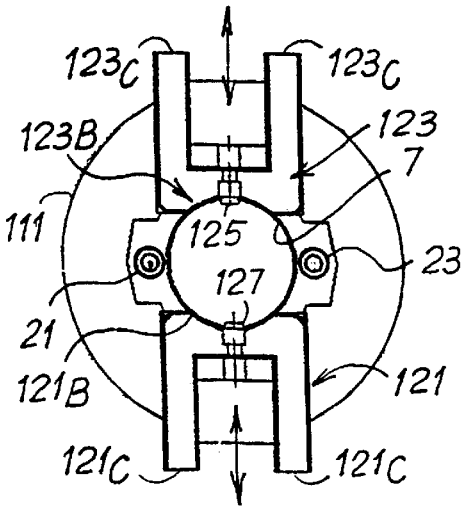
FIG. 29 is a cross section along line XXIX—XXIX of FIG. 23.
Figure 30:
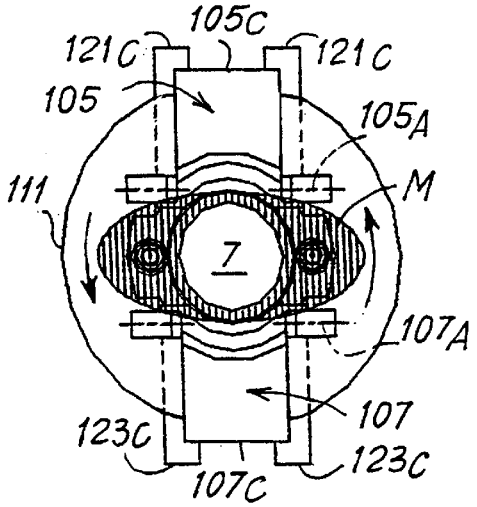
FIG. 30 is a plan view along line XXX—XXX of FIG. 23.
Figure 27:
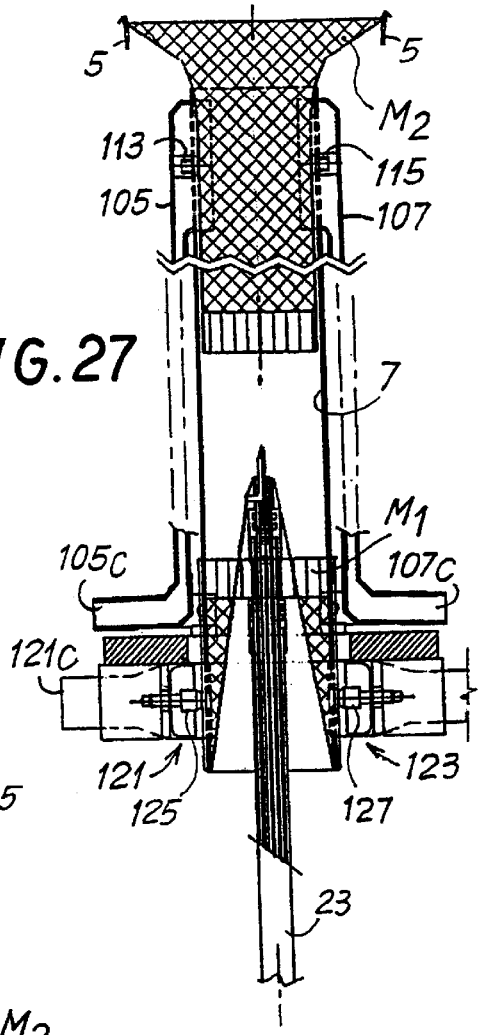
Figure 28:
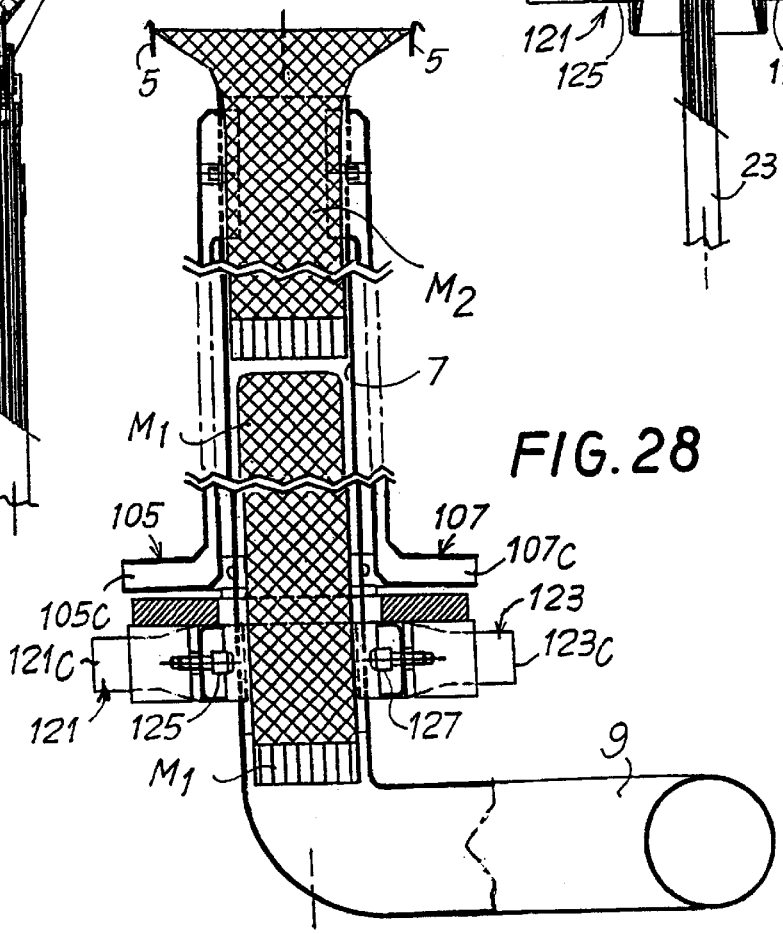

During this operation, the interior of the tubular element 7 is constantly kept under light vacuum conditions, either through oscillating suction boxes 105, 107 or through sliding suction boxes 121, 123. This enables starting the knitting cycles of the subsequent article M2 at a very early stage, as shown in FIGS. 27 and 28. In FIG. 27 the new article is under formation, while the previous article M is pushed inside the tubular element 7 for turning it inside out the second time. In FIG. 29 the completed article M is sucked away via duct 9, while knitting of the next article continues.

It will be understood that the drawing shows only an illustrative embodiment purely as a practical demonstration of the invention, which latter can be varied in its shapes and arrangements without however departing from the scope of the concept on which the invention is based.

What is claimed is:

1. A method for production of a tubular knitted article on a circular knitting machine, wherein:

a needle cylinder knits said tubular article beginning at an initial edge and finishing at a final toe;

upon completion thereof, said tubular article is partly released from needles of said needle cylinder and retained by only some of said needles in two diametrically opposite zones;

said tubular article is engaged in correspondence of said two diametrically opposite zones by transfer members;

upon engagement by said transfer members, the tubular article is completely released from said needles;

said article is turned inside out after its release from the needles of said needle cylinder, the toe of said article is transferred to below the needle cylinder, said toe is closed.

2. A method as claimed in claim 1, further comprising: turning said tubular article right side out again after having closed said toe.

3. A method as claimed in claim 1, wherein: said article is formed by said needle cylinder inside a tubular element coaxial with said needle cylinder and provided with an upper edge located underneath it, and said article is turned inside out by pulling one or more edges of the fabric adjacent to said toe in a direction parallel to the axis of said tubular element and on an outside thereof, in such a way as to cause the article to come out of said tubular element and be turned inside out as it passes over the upper edge of said tubular element.

4. A method as claimed in claim 1, wherein: said tubular article is knitted on a rotating needle cylinder; when knitting is finished, the rotary movement of the needle cylinder is slowed down or stopped and the tubular article is partly released from said needle cylinder while keeping the tubular article engaged on said needle cylinder by a small number of needles retaining one or more edges thereof; and the tubular article is gripped by said transfer members at said edges and, after complete disengagement of the article from the needles of the needle cylinder, said transfer members turn the article inside out by pulling it downward.

5. A method as claimed in claim 1, wherein: said toe is closed by a sewing device positioned beneath said needle cylinder.

6. A method as claimed in claim 1, wherein: the tubular article is turned right side out, after said toe has been closed, by said transfer members.

7. A method as claimed in claim 3, wherein: one of said transfer members is positioned underneath said tubular element and is approximately coaxially therewith, and the tubular article is turned right side out by pushing the tubular article into the tubular element by said transfer member, thus turning the article inside out a second time around a lower edge of said tubular element.

8. A method as claimed in claim 1, wherein: knitting begins on a new tubular article on the needle cylinder at the same time as the toe of said tubular article is being closed and turned inside out.

9. A device for closing a toe of a tubular knitted article, comprising:

a needle cylinder for knitting the article, and transfer members capable of engaging said tubular article at an end of the knitting process and before the article is completely released from needles of said needle cylinder;

a tubular element coaxial with said needle cylinder and extending down from an upper edge to beneath said needle cylinder, having a smaller diameter than said needle cylinder and containing the tubular article during the knitting process, said transfer members being movable on an outside of said tubular element and parallel to its axis in order to engage the tubular article close to its toe which is to be closed and transfer it downward, causing it to turn inside out as it passes over the upper edge of the tubular element.

10. Device as claimed in claim 9, wherein: said transfer members directly transfer said toe of the tubular article to closing means positioned underneath the needle cylinder.

11. Device as claimed in claim 9, wherein: said closing means comprise a sewing device.

12. Device as claimed in claim 9, wherein: said transfer members comprise means of engagement capable of engaging the tubular article by penetrating the knitted fabric forming said article.

13. Device as claimed in claim 9, wherein: two transfer members are provided acting in symmetrical positions with respect to the axis of said tubular element.

14. Device as claimed in claim 9, wherein: said tubular element has a flared and rounder upper edge.

15. Device as claimed in claim 9, wherein: said tubular element has a flared and rounded lower edge.

16. Device as claimed in claim 9, wherein: said transfer members possess a telescopic lengthening system.

17. Device as claimed in claim 9, further comprising means for turning said tubular article inside out a second time after said toe has been closed.

18. Device as claimed in claim 17, wherein: said means for turning said tubular article inside out a second time comprise a pusher positionable approximately coaxially with said tubular element, said pusher being extendable into said tubular element.

19. Device as claimed in claim 18, wherein: said pusher is one of said transfer members which is movable perpendicularly to the axis of the tubular element so as to position said one transfer member either outside or inside the tubular element.

20. Device as claimed in claim 9, wherein: said transfer members comprise extendable rods pivoting about axes perpendicular to the axis of said tubular element.

21. Device as claimed in claim 9, wherein: said tubular element is supported by a plurality of rollers that engage an outer surface of said tubular element, the tubular article being able to slide over said outer surface, between said surface and said rollers.

22. Device as claimed in claim 21, further comprising three pairs of rollers, the rollers of each pair being arranged, one close to the upper edge and one close to the lower edge of the tubular element, said pairs being offset by approximately 120° from each other about the axis of the tubular element.

23. Device as claimed in claim 21, further comprising additional means for supporting the tubular element, said additional supporting means being retractable away from the outer surface of said tubular element.

24. Device as claimed in claim 9, wherein: said transfer members can execute a movement perpendicular to the axis of the needle cylinder so as to bring the toe of the tubular article into engagement with sewing means situated eccentrically with respect to said needle cylinder.

25. Device as claimed in claim 9, further comprising a suction sleeve associated with, and movable relative to, said tubular element.

26. Device as claimed in claims 25, wherein: said suction sleeve has an opening approximately coaxial with the tubular element so that said pusher can pass through the tubular element when turning the tubular element right side out.

27. Device as claimed in claim 9, further comprising movable suction boxes which keep the interior of said tubular element under a vacuum condition.

28. Device according to claim 27, further comprising two pairs of suction boxes which are alternately into engagement or out of engagement with said tubular element.

29. Device according to claim 27, wherein: said suction boxes are provided with supporting means for supporting the tubular element.

30. Method for producing a tubular knitted article on a circular knitting machine, including the steps of:

knitting said tubular article beginning at an initial edge and finishing at a final toe, said article being formed by said needle cylinder inside a tubular element coaxial with said needle cylinder and extending from an upper edge to beneath said needle cylinder;

at an end of the knitting of said tubular article, transferring the tubular article from needles of the needle cylinder to transfer members;

turning said article inside out by pulling at least one edge of the fabric adjacent to said toe in a direction parallel to the axis of said tubular element and on an outside thereof, in such a way as to cause the article to come out of said tubular element and be turned inside out as it passes over the upper edge of said tubular element;

transferring the toe of said article to below the needle cylinder;

closing said toe.

31. Method for producing of a tubular knitted article on a circular knitting machine, including the steps of:

knitting said tubular article at a needle cylinder beginning at an initial edge and finishing at a final toe;

at an end of the knitting of said tubular article, partly releasing said tubular article from needles of the needle cylinder and retaining said tubular article by said needles only in correspondence of two diametrically opposite zones;

engaging said tubular article by transfer members in correspondence of said two diametrically opposite zones;

completely releasing said tubular article from said needles;

transferring said tubular article from the needles to transfer members;

turnings said article inside out;

transferring said tubular article;

transferring the toe of said article to below the needle cylinder to means for closing said toe;

closings said toe;

turning said tubular article right side out again after having closed said toe.

32. Method for producing of a tubular knitted article on a circular knitting machine, including the steps of:

arranging a needle cylinder with needles and, coaxially to said needle cylinder a tubular element, said tubular element having an upper edge and a lower edge;

knitting said tubular article beginning at an initial edge and finishing at a final toe, said tubular article being formed inside said tubular element;

at an end of the knitting of said tubular article, engaging said tubular article by transfer members and then releasing said tubular article completely from said needles;

turning said article inside out by pulling at least one edge of the fabric adjacent to said toe in a direction parallel to the axis of said tubular element and on an outside thereof, in such a way as to cause the article to come out of said tubular element and be turned inside out as it passes over an upper edge of said tubular element;

transferring the toe of said tubular article to below the needle cylinder;

closing said toe;

turning said tubular article inside out again by pushing the tubular article into the tubular element thus turnings the article inside out a second time around a lower edge of said tubular element.

33. Method for producing of a tubular knitted article on a circular knitting machine, including the steps of:

knitting said tubular article at a needle cylinder beginning at an initial edge and finishing at a final toe;

at an end of the knitting of said tubular article, transferring said knitted tubular article from needles of the needle machine to transfer members, said transfer members engaging said tubular article before said tubular article is completely released from the needles:

turning said article inside out;

said same transfer members transferring said tubular article to below the needle cylinder and to means for closing said toe;

closing said toe.

* * * * *